US011454239B2

(12) United States Patent
Hoshino

(10) Patent No.: US 11,454,239 B2
(45) Date of Patent: Sep. 27, 2022

(54) ROTARY COMPRESSOR

(71) Applicant: FUJITSU GENERAL LIMITED, Kanagawa (JP)

(72) Inventor: Shuhei Hoshino, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 88 days.

(21) Appl. No.: 17/045,905

(22) PCT Filed: Feb. 13, 2019

(86) PCT No.: PCT/JP2019/005121
§ 371 (c)(1),
(2) Date: Oct. 7, 2020

(87) PCT Pub. No.: WO2019/198326
PCT Pub. Date: Oct. 17, 2019

(65) Prior Publication Data

US 2021/0033094 A1 Feb. 4, 2021

(30) Foreign Application Priority Data

Apr. 12, 2018 (JP) ..... JP2018-076929

(51) Int. Cl.
*F04C 23/00* (2006.01)
*F04C 18/356* (2006.01)
(Continued)

(52) U.S. Cl.
CPC ..... *F04C 23/008* (2013.01); *F04C 18/3564* (2013.01); *F04C 29/02* (2013.01);
(Continued)

(58) Field of Classification Search
CPC .. F04C 23/008; F04C 18/3564; F04C 29/023; F04C 29/028; F04C 29/025; F04C 29/02; F04C 2240/603; F04C 18/322
See application file for complete search history.

(56) References Cited

U.S. PATENT DOCUMENTS 5,242,280 A * 9/1993 Fujio ..... F04C 23/008 418/268
8,104,307 B2 * 1/2012 Hasegawa ..... F04C 23/008 62/468
(Continued)

FOREIGN PATENT DOCUMENTS

CN 1580565 A 2/2005
CN 201714669 U 1/2011
(Continued)

OTHER PUBLICATIONS

Nov. 3, 2021, Chinese Office Action issued for related CN application No. 201980024694.3.
Jun. 28, 2022, Chinese Office Action issued for related CN Application No. 201980024694.3.

*Primary Examiner* — Deming Wan
(74) *Attorney, Agent, or Firm* — Paratus Law Group, PLLC

(57) ABSTRACT

A rotary compressor includes: a compressor housing stores lubricating oil; a compression unit compresses the refrigerant; and a motor drives the compression unit. The compression unit includes a cylinder, an upper end plate and a lower end plate, a main bearing provided on the upper end plate, a sub bearing provided on the lower end plate, a rotary shaft supported by the main bearing and the sub bearing, and a piston fitted to the rotary shaft. An inner peripheral surface of a shaft hole of the sub bearing is provided with an oil-supply groove having a helical shape that supplies the lubricating oil from a lower end to an upper end of the shaft hole, and the oil-supply groove is inclined with respect to the
(Continued)

rotary shaft in a rotating direction and extends from the lower end toward the upper end of the rotary shaft in the rotating direction.

7 Claims, 7 Drawing Sheets

(51) Int. Cl.
*F04C 29/02* (2006.01)
*F04C 18/32* (2006.01)

(52) U.S. Cl.
CPC ..... *F04C 29/028* (2013.01); *F04C 2210/26* (2013.01); *F04C 2240/30* (2013.01); *F04C 2240/40* (2013.01); *F04C 2240/60* (2013.01)

(56) References Cited

U.S. PATENT DOCUMENTS

2005/0053506 A1* 3/2005 Cho ..... F04C 23/008 418/23
2015/0322949 A1* 11/2015 Oyagi ..... F04C 29/02 418/63

FOREIGN PATENT DOCUMENTS

| | | | |
|---|---|---|---|
| JP | S53-001109 | U | 1/1978 |
| JP | H10-047281 | A | 2/1998 |
| JP | 2004-225578 | A | 8/2004 |
| JP | 2005-061397 | A | 3/2005 |

* cited by examiner

ROTARY COMPRESSOR

CROSS REFERENCE TO PRIOR APPLICATION

This application is a National Stage Patent Application of PCT International Patent Application No. PCT/JP2019/005121 (filed on Feb. 13, 2019) under 35 U.S.C. § 371, which claims priority to Japanese Patent Application No. 2018-076929 (filed on Apr. 12, 2018), which are all hereby incorporated by reference in their entirety.

FIELD

The present invention relates to a rotary compressor.

BACKGROUND

There is a known rotary compressor having a structure in which lubricating oil stored in a lower part of a compressor housing is sucked up from an oil-supply vertical hole inside a rotary shaft and then supplied to the sliding portions such as a compression unit from an oil-supply lateral hole communicating with the oil-supply vertical hole. In such a structure, the lubricating oil ensures the lubricity of the sliding portions and seals the inside of the cylinder of the compression unit.

When supplying lubricating oil through the oil-supply vertical hole inside the rotary shaft, centrifugal pump action works inside the oil-supply vertical hole to suck up the lubricating oil from the lower end of the rotary shaft to the oil-supply lateral hole along the oil-supply vertical hole. This type of rotary compressor sometimes has a structure in which the lubricating oil supplied from the oil-supply lateral hole to the sliding portions flows downward along an outer peripheral surface of the rotary shaft, thereby supplying the lubricating oil to the sliding portions of the sub bearing.

A certain rotary compressor among the related art supplies the lubricating oil to the sliding portions by using an oil-supply groove provided helically on the outer peripheral surface of the rotary shaft in addition to the oil-supply vertical hole inside the rotary shaft. When the lubricating oil is supplied along the oil-supply groove of the rotary shaft, the lubricating oil is sucked up along the oil-supply groove of the rotary shaft by the viscous pump action that utilizes the viscosity of the lubricating oil that exists between the inner peripheral surface of the sub bearing and the outer peripheral surface of the rotary shaft.

CITATION LIST

Patent Literature

Patent Literature 1: JP 10-47281 A

SUMMARY

Technical Problem

In a case where the shaft diameter of the rotary shaft is small or where the rotation speed of the rotary shaft is low at the time of supplying lubricating oil through the oil-supply vertical hole of the rotary shaft, the centrifugal force generated in the lubricating oil inside the oil-supply vertical hole of the rotary shaft is reduced, leading to a decrease in the amount of lubricating oil supplied through the oil-supply vertical hole and the oil-supply lateral hole. This might lead to the reduction of the amount of lubricating oil supplied to the sliding portions of the compression unit and the bearing. This would also decrease the sealability provided by the lubricating oil in the cylinder of the compression unit, leading to the leak of the gas under compression from the compression chamber to the suction chamber, resulting in deterioration of the performance of the rotary compressor. Furthermore, it is difficult to compensate for the reduction in the supply amount of the lubricating oil only by providing the oil-supply groove on the rotary shaft.

The disclosed technique is made in view of the above and aims to provide a rotary compressor capable of stably supplying lubricating oil to the sliding portions.

Solution to Problem

A rotary compressor disclosed in this application, according to an aspect, includes: a compressor housing hermetically sealed, having a cylindrical shape to be vertically arranged, being provided with a discharge unit and a suction unit of refrigerant, and configured to store lubricating oil in a lower part of the compressor housing; a compression unit disposed at a lower part of the compressor housing and configured to compress the refrigerant sucked from the suction unit and discharge the compressed refrigerant from the discharge unit; and a motor disposed on an upper part of the compressor housing and configured to drive the compression unit, the compression unit including a cylinder having an annular shape, an upper end plate that closes an upper side of the cylinder, a lower end plate that closes a lower side of the cylinder, a main bearing provided on the upper end plate, a sub bearing provided on the lower end plate, a rotary shaft supported by the main bearing and the sub bearing so as to be rotated by the motor, and a piston having an annular shape, and configured to be fitted to an eccentric part of the rotary shaft and to revolve along an inner peripheral surface of the cylinder so as to form a cylinder chamber within the cylinder, wherein an inner peripheral surface of a shaft hole of the sub bearing is provided with an oil-supply groove having a helical shape that supplies the lubricating oil from a lower end to an upper end of the shaft hole, and the oil-supply groove is inclined with respect to the rotary shaft in a rotating direction and extends from the lower end toward the upper end of the rotary shaft in the rotating direction.

Advantageous Effects of Invention

According to one aspect of the rotary compressor disclosed in the present application, it is possible to stably supply the lubricating oil to the sliding portions.

DESCRIPTION OF EMBODIMENTS

Exemplary embodiments of the rotary compressor disclosed in the present application will be described below in detail with reference to the drawings. The rotary compressor disclosed in the present application is not limited to the exemplary embodiments described below.

Exemplary Embodiment (Configuration of Rotary Compressor)

Figure 1:
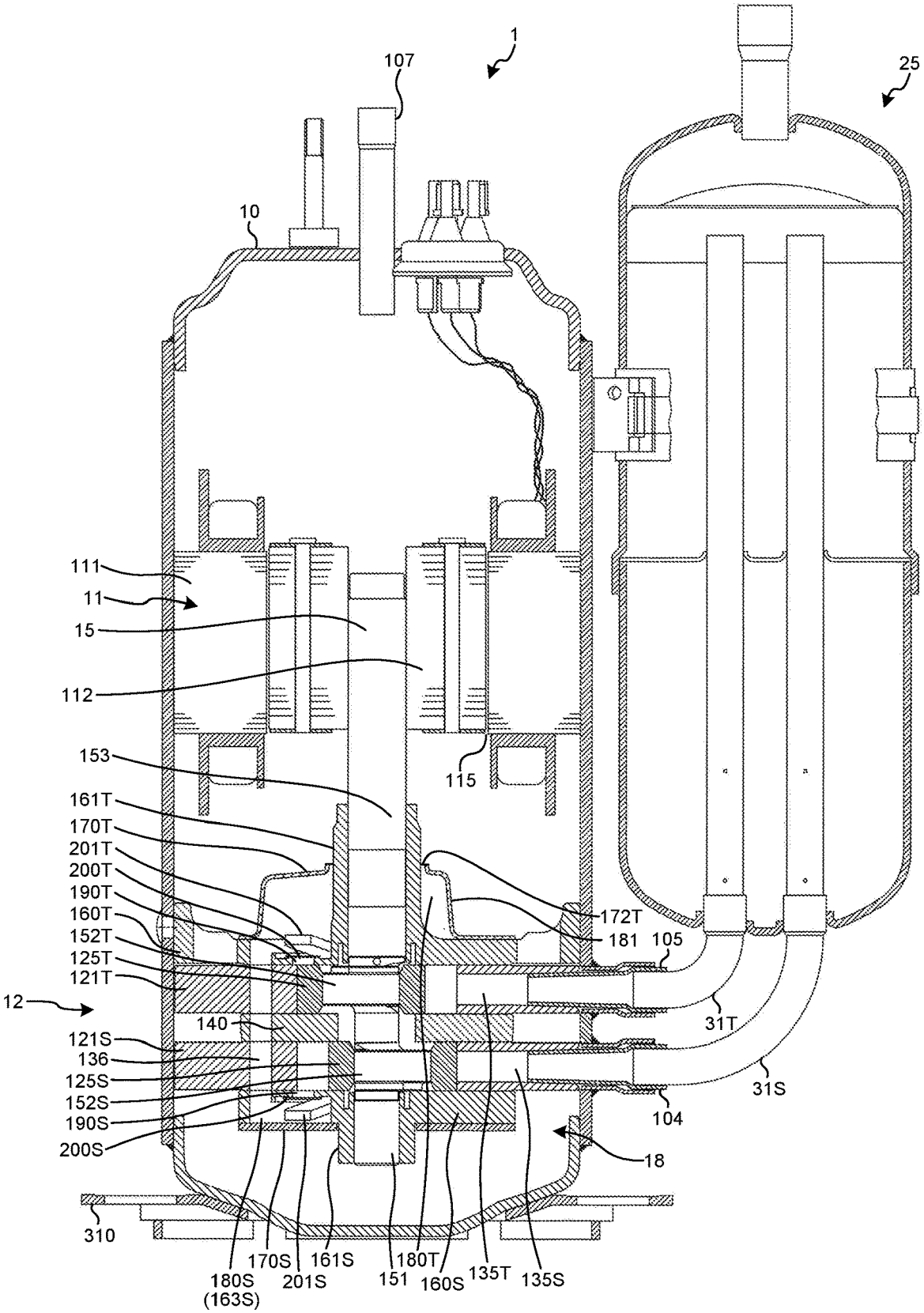
FIG. 1 is a vertical cross-sectional view illustrating a rotary compressor of an exemplary embodiment.
Figure 2:
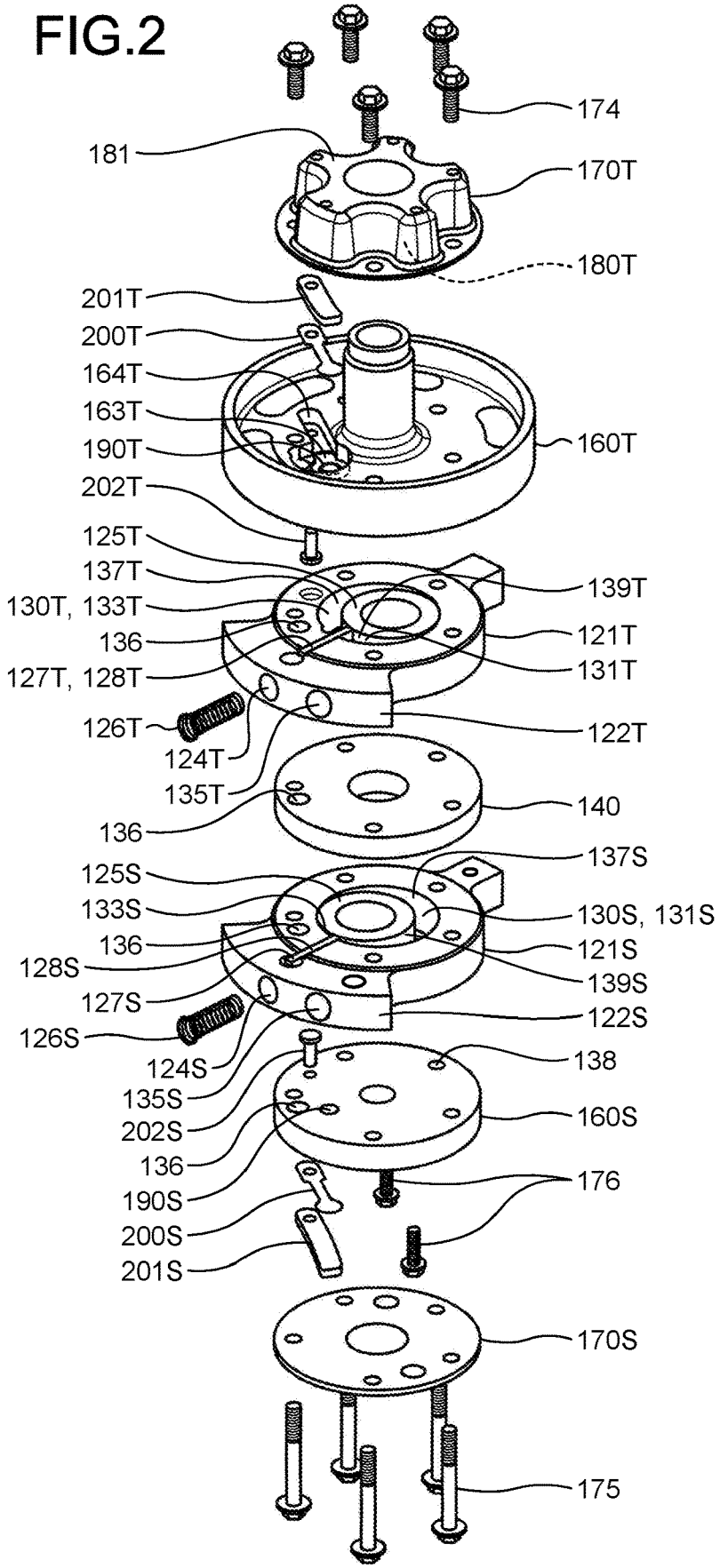
FIG. 2 is an exploded perspective view illustrating a compression unit of the rotary compressor of the exemplary embodiment.

FIG. 1 is a vertical cross-sectional view illustrating a rotary compressor of an exemplary embodiment. FIG. 2 is an exploded perspective view illustrating a compression unit of the rotary compressor of the exemplary embodiment.

As illustrated in FIG. 1, a rotary compressor 1 includes a compression unit 12 disposed at a lower part of a compressor housing 10 that is hermetically sealed and has a cylindrical shape to be vertically arranged, a motor 11 disposed on an upper part of the compressor housing 10 and configured to drive the compression unit 12 via a rotary shaft 15, and an accumulator 25 that is hermetically sealed, has a cylindrical shape to be vertically arranged, and is fixed to an outer peripheral surface of the compressor housing 10.

The compressor housing 10 includes an upper suction pipe 105 and a lower suction pipe 104 for sucking the refrigerant, and the upper suction pipe 105 and the lower suction pipe 104 are provided on the lower side surface of the compressor housing 10. The accumulator 25 is connected to an upper cylinder chamber 130T (refer to FIG. 2) of an upper cylinder 121T via the upper suction pipe 105 and an accumulator upper bending pipe 31T serving as a suction unit, and is connected to a lower cylinder chamber 130S (refer to FIG. 2) of a lower cylinder 121S via the lower suction pipe 104 and an accumulator lower bending pipe 31S serving as a suction unit. In the present exemplary embodiment, the upper suction pipe 105 and the lower suction pipe 104 overlap each other in the circumferential direction of the compressor housing 10 so as to be located at the same position.

The motor 11 includes a stator 111 disposed on the outside and a rotor 112 disposed on the inside. The stator 111 is fixed to the inner peripheral surface of the compressor housing 10 by shrink fitting or welding. The rotor 112 is fixed to the rotary shaft 15 by shrink fitting.

On the rotary shaft 15, a sub shaft 151 below a lower eccentric part 152S is rotatably supported by a sub bearing 161S provided on a lower end plate 160S, and a main shaft 153 below an upper eccentric part 152T is rotatably supported by a main bearing 161T provided on an upper end plate 160T. The rotary shaft 15 is provided with the upper eccentric part 152T and the lower eccentric part 152S with a phase difference of 180° from each other. On the rotary shaft 15, an upper piston 125T is supported on the upper eccentric part 152T, and a lower piston 125S is supported on the lower eccentric part 152S. With this configuration, while being rotatably supported with respect to the entire compression unit 12, the rotary shaft 15 causes an outer peripheral surface 139T of the upper piston 125T to revolve along an inner peripheral surface 137T of the upper cylinder 121T and causes an outer peripheral surface 139S of the lower piston 125S to revolve along an inner peripheral surface 137S of the lower cylinder 121S.

In the lower part of the compressor housing 10, lubricating oil 18 for ensuring the lubricity of sliding portions configured to slide in the compression unit 12, such as between the upper cylinder 121T and the upper piston 125T and between the lower cylinder 121S and the lower piston 125S as well as sealing (enclosing) an upper compression chamber 133T (refer to FIG. 2) and a lower compression chamber 133S (refer to FIG. 2), is sealed in an amount that substantially immerses the entire compression unit 12. On the lower side of the compressor housing 10, a mounting leg 310 (refer to FIG. 1) that locks a plurality of elastic supporting members (not illustrated), which supports the entire rotary compressor 1, is fixed.

As illustrated in FIG. 1, the compression unit 12 compresses the refrigerant sucked from the upper suction pipe 105 and the lower suction pipe 104, and then discharges the refrigerant from a discharge pipe 107 described below. As illustrated in FIG. 2, the compression unit 12 has a stacked structure including, in the order from the top, an upper end plate cover 170T having a bulging part 181 with a hollow space formed therein, the upper end plate 160T, an upper cylinder 121T having an annular shape, an intermediate partition plate 140, a lower cylinder 121S having an annular shape, the lower end plate 160S, and a lower end plate cover 170S having a flat plate shape. The entire compression unit 12 is fixed by a plurality of through bolts 174 and 175 each of which being disposed on a substantially concentric circle from above and below, and by auxiliary bolts 176.

The upper cylinder 121T has the inner peripheral surface 137T having a cylindrical shape. The upper piston 125T having an outer diameter smaller than the inner diameter of the inner peripheral surface 137T of the upper cylinder 121T is disposed inside the inner peripheral surface 137T of the upper cylinder 121T. The upper compression chamber 133T for sucking, compressing, and discharging the refrigerant is formed between the inner peripheral surface 137T of the upper cylinder 121T and the outer peripheral surface 139T of the upper piston 125T. The inner peripheral surface 137S having a cylindrical shape is formed in the lower cylinder 121S. The lower piston 125S having an outer diameter smaller than the inner diameter of the inner peripheral surface 137S of the lower cylinder 121S is disposed inside the inner peripheral surface 137S of the lower cylinder 121S. The lower compression chamber 133S for sucking, compressing, and discharging the refrigerant is formed between the inner peripheral surface 137S of the lower cylinder 121S and the outer peripheral surface 139S of the lower piston 125S.

As illustrated in FIG. 2, the upper cylinder 121T includes an upper protrusion 122T protruding from the outer peripheral portion to the outer peripheral side of the cylindrical inner peripheral surface 137T in the radial direction. The upper protrusion 122T is provided with an upper vane slot 128T that extends radially outward from the upper cylinder chamber 130T. Inside the upper vane slot 128T, an upper vane 127T is slidably disposed. The lower cylinder 121S includes a lower protrusion 122S protruding from the outer peripheral portion to the outer peripheral side of the cylindrical inner peripheral surface 137S in the radial direction. The lower protrusion 122S is provided with a lower vane slot 128S that extends radially outward from the lower cylinder chamber 130S. Inside the lower vane slot 128S, a lower vane 127S is slidably disposed.

The upper protrusion 122T is formed over a predetermined range along the inner peripheral surface 137T of the upper cylinder 121T in the circumferential direction. The lower protrusion 122S is formed over a predetermined range along the inner peripheral surface 137S of the lower cylinder 121S in the circumferential direction. The upper protrusion 122T and the lower protrusion 122S are used as chuck holders to fix the upper cylinder 121T and the lower cylinder 121S to the processing jig during processing. By fixing the upper protrusion 122T and the lower protrusion 122S to the processing jig, the upper cylinder 121T and the lower cylinder 121S are positioned at predetermined positions.

The upper protrusion 122T is provided with an upper spring hole 124T at a position overlapping the upper vane slot 128T at a depth not penetrating to reach the upper cylinder chamber 130T, from the outer side surface. An upper spring 126T is disposed in the upper spring hole 124T. The lower protrusion 122S is provided with a lower spring hole 124S at a position overlapping the lower vane slot 128S at a depth not penetrating to reach the lower cylinder chamber 130S, penetrating from the outer side surface. A lower spring 126S is disposed in the lower spring hole 124S.

Furthermore, the upper cylinder 121T is provided with an upper pressure introduction channel 129T that allows communication between the outside of the upper vane slot 128T in the radial direction and the inside of the compressor housing 10 through an opening to introduce the compressed refrigerant in the compressor housing 10 and apply a back pressure generated by the pressure of the refrigerant to the upper vane 127T. Furthermore, the lower cylinder 121S is provided with a lower pressure introduction channel 129S that allows communication between the outside of the lower vane slot 128S in the radial direction and the inside of the compressor housing 10 through an opening to introduce the compressed refrigerant in the compressor housing 10 and apply a back pressure generated by the pressure of the refrigerant to the lower vane 127S.

The upper protrusion 122T of the upper cylinder 121T is provided with an upper suction hole 135T that fits into the upper suction pipe 105. The lower protrusion 122S of the lower cylinder 121S is provided with a lower suction hole 135S that fits into the lower suction pipe 104.

As illustrated in FIG. 2, the upper side of the upper cylinder chamber 130T is closed by the upper end plate 160T and the lower side of the upper cylinder chamber 130T is closed by an intermediate partition plate 140. The upper side of the lower cylinder chamber 130S is closed by the intermediate partition plate 140 and the lower side the lower cylinder chamber 130S is closed by the lower end plate 160S.

When the upper vane 127T is pressed by the upper spring 126T to come into contact with the outer peripheral surface 139T of the upper piston 125T, the upper cylinder chamber 130T is divided into an upper suction chamber 131T communicating with the upper suction hole 135T and the upper compression chamber 133T communicating with an upper discharge hole 190T provided on the upper end plate 160T. When the lower vane 127S is pressed by the lower spring 126S to come into contact with the outer peripheral surface 139S of the lower piston 125S, the lower cylinder chamber 130S is divided into a lower suction chamber 131S communicating with the lower suction hole 135S and the lower compression chamber 133S communicating with a lower discharge hole 190S provided on the lower end plate 160S.

Furthermore, the upper discharge hole 190T is provided in proximity to the upper vane slot 128T, and the lower discharge hole 190S is provided in proximity to the lower vane slot 128S. The refrigerant compressed in the upper compression chamber 133T is discharged from the upper compression chamber 133T through the upper discharge hole 190T. The refrigerant compressed in the lower compression chamber 133S is discharged from the lower compression chamber 133S through the lower discharge hole 190S.

As illustrated in FIG. 2, the upper end plate 160T is provided with the upper discharge hole 190T which penetrates the upper end plate 160T to communicate with the upper compression chamber 133T of the upper cylinder 121T. On the outlet side of the upper discharge hole 190T, an upper valve seat is formed around the upper discharge hole 190T. The upper side of the upper end plate 160T (on the side of the upper end plate cover 170T) is provided with an upper discharge valve housing recess 164T extending in a groove shape from the position of the upper discharge hole 190T toward the outer periphery of the upper end plate 160T.

The upper discharge valve housing recess 164T houses an entire upper discharge valve 200T of a reed valve type and an entire upper discharge valve retainer 201T that regulates the opening of the upper discharge valve 200T. A base end of the upper discharge valve 200T is fixed in the upper discharge valve housing recess 164T by an upper rivet 202T, and a tip end of the upper discharge valve 200T opens and closes the upper discharge hole 190T. The base end of the upper discharge valve retainer 201T overlaps the upper discharge valve 200T and is fixed in the upper discharge valve housing recess 164T by the upper rivet 202T, and the tip end of the upper discharge valve retainer 201T is curved (warped) in an opening direction of the upper discharge valve 200T and regulates the opening of the upper discharge valve 200T. Moreover, the upper discharge valve housing recess 164T is formed to be slightly wider than the width of the upper discharge valve 200T and the upper discharge valve retainer 201T so as to house the upper discharge valve 200T and the upper discharge valve retainer 201T as well as performing positioning of the upper discharge valve 200T and the upper discharge valve retainer 201T.

The lower end plate 160S is provided with the lower discharge hole 190S penetrating the lower end plate 160S to communicate with the lower compression chamber 133S of the lower cylinder 121S. On the outlet side of the lower discharge hole 190S, a lower valve seat having an annular shape is formed around the lower discharge hole 190S. The lower side of the lower end plate 160S (on the side of the lower end plate cover 170S) is provided with a lower discharge valve housing recess 164S extending in a groove shape from the position of the lower discharge hole 190S toward the outer periphery of the lower end plate 160S (refer to FIG. 3).

The lower discharge valve housing recess 164S houses an entire lower discharge valve 200 of a reed valve type and an entire lower discharge valve retainer 201S that regulates the opening of the lower discharge valve 200S. A base end of the lower discharge valve 200S is fixed in the lower discharge valve housing recess 164S by a lower rivet 202S, and a tip end of the lower discharge valve 200S opens and closes the lower discharge hole 190S. A base end of the lower discharge valve retainer 201S overlaps the lower discharge valve 200S and is fixed in the lower discharge valve housing recess 164S by the lower rivet 202S, and a tip end of the lower discharge valve retainer 201S is curved (warped) in an opening direction of the lower discharge valve 200S and regulates the opening of the lower discharge valve 200. Moreover, the lower discharge valve housing recess 164S is formed to be slightly wider than the width of the lower discharge valve 200S and the lower discharge valve retainer 201S so as to house the lower discharge valve 200S and the lower discharge valve retainer 201S as well as performing positioning of the lower discharge valve 200S and the lower discharge valve retainer 201S.

Furthermore, an upper end plate cover chamber 180T is formed between the upper end plate 160T and the upper end plate cover 170T having the bulging part 181, which are closely fixed to each other. A lower end plate cover chamber 180S (refer to FIG. 1) is formed between the lower end plate 160S and the flat plate-shaped lower end plate cover 170S, which are closely fixed to each other. As illustrated in FIG. 1, the compression unit 12 has a refrigerant passage hole 136 penetrating the lower end plate 160S, the lower cylinder 121S, the intermediate partition plate 140, the upper end plate 160T, and the upper cylinder 121T so as to communicate the lower end plate cover chamber 180S with the upper end plate cover chamber 180T.

A lower discharge chamber recess 163S communicates with the lower discharge valve housing recess 164S. The lower discharge chamber recess 163S is formed to have the same depth as the lower discharge valve housing recess 164S so as to overlap the lower discharge hole 190S side of the lower discharge valve housing recess 164S. The lower discharge hole 190S side of the lower discharge valve housing recess 164S is housed in the lower discharge chamber recess 163S. The refrigerant passage hole 136 is disposed at a position of the lower discharge chamber recess 163S and at a position communicating with the lower discharge chamber recess 163S.

Furthermore, the lower surface of the lower end plate 160S (a contact surface with the lower end plate cover 170S) is provided with a plurality of bolt holes 138 to allow the passage of through bolts 175 or the like, at a region other than the region where the lower discharge chamber recess 163S and the lower discharge valve housing recess 164S are formed.

The refrigerant passage hole 136 is disposed at a position of an upper discharge chamber recess 163T and at a position communicating with the upper discharge chamber recess 163T. The upper discharge chamber recess 163T and the upper discharge valve housing recess 164T formed in the upper end plate 160T are also formed in the shapes similar to the shapes of the lower discharge chamber recess 163S and the lower discharge valve housing recess 164S formed in the lower end plate 160S, respectively. The upper end plate cover chamber 180T is formed with the bulging part 181 having a dome shape on the upper end plate cover 170T, the upper discharge chamber recess 163T, and the upper discharge valve housing recess 164T.

Hereinafter, a flow of the refrigerant generated by the rotation of the rotary shaft 15 will be described. In the upper cylinder chamber 130T, the rotation of the rotary shaft 15 causes the upper piston 125T fitted to the upper eccentric part 152T of the rotary shaft 15 to revolve along the inner peripheral surface 137T of the upper cylinder 121T. This revolution causes the upper suction chamber 131T to suck the refrigerant from the upper suction pipe 105 while expanding the volume and causes the upper compression chamber 133T to compress the refrigerant while reducing the volume. When the pressure of the compressed refrigerant exceeds the pressure of the upper end plate cover chamber 180T outside the upper discharge valve 200T, the upper discharge valve 200T opens and the refrigerant is discharged from the upper compression chamber 133T to the upper end plate cover chamber 180T. The refrigerant discharged to the upper end plate cover chamber 180T is discharged into the compressor housing 10 through an upper end plate cover discharge hole 172T (refer to FIG. 1) provided on the upper end plate cover 170T.

Moreover, in the lower cylinder chamber 130S, the rotation of the rotary shaft 15 causes the lower piston 125S fitted to the lower eccentric part 152S of the rotary shaft 15 to revolve along the inner peripheral surface 137S of the lower cylinder 121S. This revolution causes the lower suction chamber 131S to suck the refrigerant from the lower suction pipe 104 while expanding the volume and causes the lower compression chamber 133S to compress the refrigerant while reducing the volume. When the pressure of the compressed refrigerant exceeds the pressure of the lower end plate cover chamber 180S outside the lower discharge valve 200S, the lower discharge valve 200S opens and the refrigerant is discharged from the lower compression chamber 133S to the lower end plate cover chamber 180S. The refrigerant discharged to the lower end plate cover chamber 180S passes through the refrigerant passage hole 136 and the upper end plate cover chamber 180T so as to be discharged into the compressor housing 10 from the upper end plate cover discharge hole 172T provided on the upper end plate cover 170T.

The refrigerant discharged into the compressor housing 10 passes through a notch (not illustrated) provided on the outer periphery of the stator 111 to provide vertical communication, a gap (not illustrated) in the winding portion of the stator 111, or a gap 115 (refer to FIG. 1) between the stator 111 and the rotor 112, so as to be guided to the upper portion of the motor 11, and then is discharged from the discharge pipe 107 as a discharge unit disposed in the upper part of the compressor housing 10.

(Characteristic Configuration of Rotary Compressor)

Figure 3:
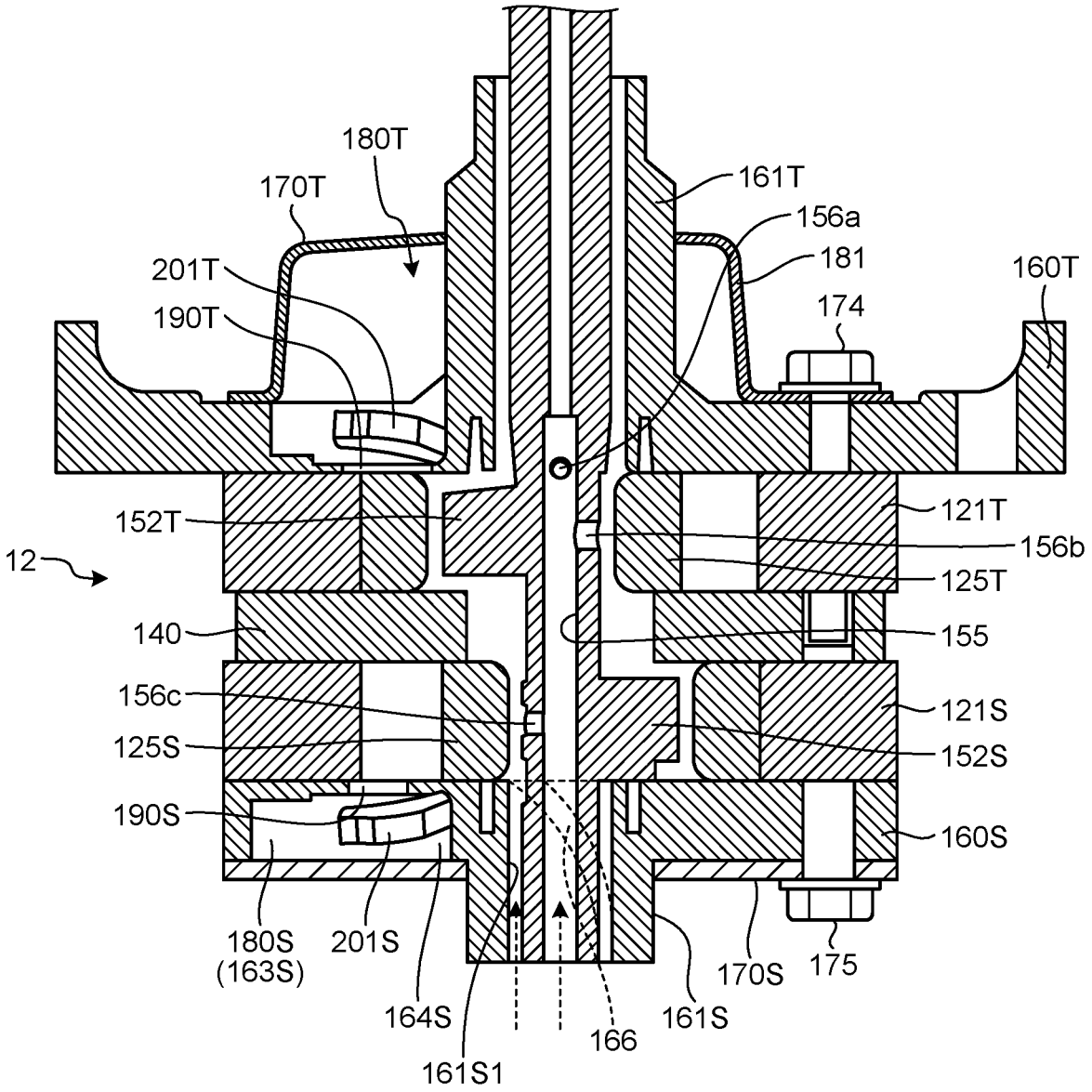
FIG. 3 is a vertical cross-sectional view illustrating a main part of the compression unit of the rotary compressor of the exemplary embodiment.

Next, a characteristic configuration of the rotary compressor 1 of the exemplary embodiment will be described. The present exemplary embodiment is characterized by an oil-supply structure that sucks up the lubricating oil 18 stored in the lower part of the compressor housing 10 and supplies the lubricating oil 18 to the sliding portion. FIG. 3 is a vertical cross-sectional view illustrating a main part of the compression unit 12 of the rotary compressor 1 of the exemplary embodiment. As illustrated in FIG. 3, in the present exemplary embodiment, the lubricating oil 18 stored in the lower part inside the compressor housing 10 is sucked up from an oil-supply vertical hole 155 (described below) of the rotary shaft 15 (first oil-supply structure) while the lubricating oil 18 is sucked up along an oil-supply groove 166 (described below) provided in the sub bearing 161S of the lower end plate 160S (second oil-supply structure).

(Oil-Supply Structure of Rotary Shaft)

Figure 4:
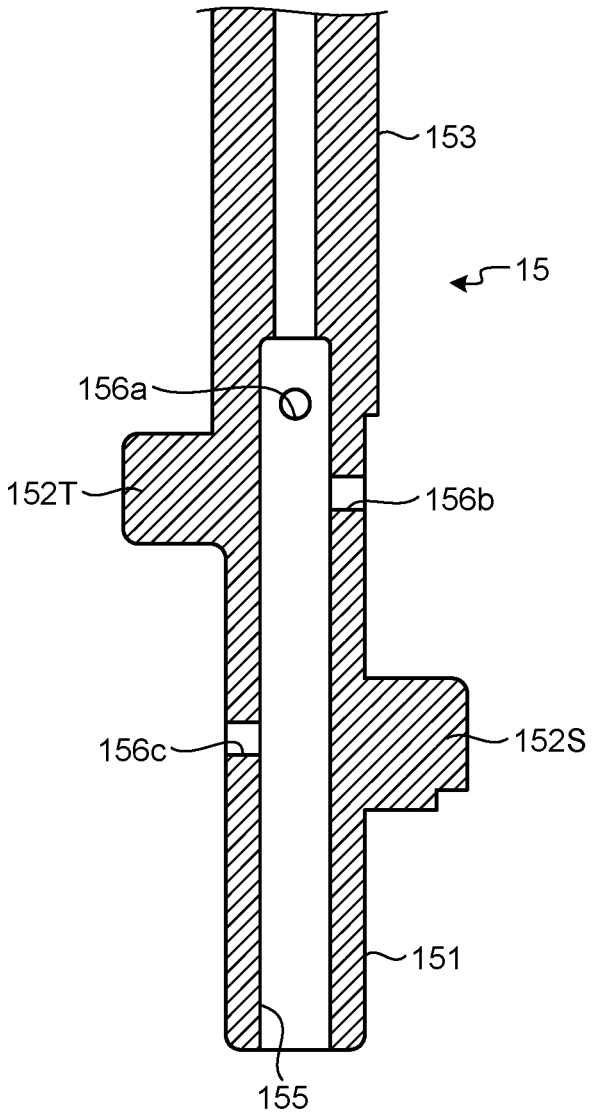
FIG. 4 is a vertical cross-sectional view illustrating a rotary shaft of the rotary compressor of the exemplary embodiment.

FIG. 4 is a vertical cross-sectional view illustrating the rotary shaft 15 of the rotary compressor 1 of the exemplary embodiment. As illustrated in FIGS. 3 and 4, the oil-supply vertical hole 155 penetrating from the lower end to the upper end of the rotary shaft 15 is formed inside the rotary shaft 15 in the axial direction of the rotary shaft 15. Furthermore, the rotary shaft 15 is provided with a first oil-supply lateral hole 156*a*, a second oil-supply lateral hole 156*b*, and a third oil-supply lateral hole 156*c*, each of which communicating with the oil-supply vertical hole 155. The first oil-supply lateral hole 156*a*, the second oil-supply lateral hole 156*b*, and the third oil-supply lateral hole 156*c* extend in the radial direction of the rotary shaft 15, so as to penetrate from the oil-supply vertical hole 155 to the outer peripheral surface of the rotary shaft 15.

The first oil-supply lateral hole 156*a* is provided in the main shaft 153 at a position adjacent to the upper eccentric part 152T. The second oil-supply lateral hole 156*b* is provided on the opposite side of the upper eccentric part 152T in the circumferential direction of the rotary shaft 15 so as to face the upper eccentric part 152T. The third oil-supply lateral hole 156*c* is provided on the opposite side of the lower eccentric part 152S in the circumferential direction of the rotary shaft 15 so as to face the lower eccentric part 152S.

The oil-supply vertical hole 155 sucks the lubricating oil 18 from the lower end of the rotary shaft 15 by the centrifugal pump action generated by the centrifugal force generated at the rotation of the rotary shaft 15. The lubricating oil 18 sucked up from the lower end to the upper end of the oil-supply vertical hole 155 overflows from the upper end of the main shaft 153 of the rotary shaft 15 to the outer peripheral surface of the rotary shaft 15 and runs downward along the outer peripheral surface of the rotary shaft 15, so as to be supplied to the main bearing 161T and to the sliding portions below the main bearing 161T.

In the rotary shaft 15 in the present exemplary embodiment, the first oil-supply lateral hole 156*a*, the second oil-supply lateral hole 156*b*, and the third oil-supply lateral hole 156*c* are provided only in the main shaft 153, the upper eccentric part 152T, and the lower eccentric part 152S, whereas no oil-supply lateral hole is provided in the sub shaft 151. That is, the first oil-supply lateral hole 156*a*, the second oil-supply lateral hole 156*b*, and the third oil-supply lateral hole 156*c* are provided at positions other than the position to face the oil-supply groove 166 (described below) when the rotary shaft 15 rotates. According to the present exemplary embodiment, a shaft hole 16151 of the sub bearing 161S is constantly lubricated by the lubricating oil 18 sucked up by the oil-supply groove 166 described below. This makes it possible to omit the formation of the oil-supply lateral hole in the sub shaft 151, and thus possible to suppress the reduction of the mechanical strength of the sub shaft 151 due to the formation of the oil-supply lateral hole.

(Oil-Supply Structure of the Sub Bearing on Lower End Plate)

Figure 5A:
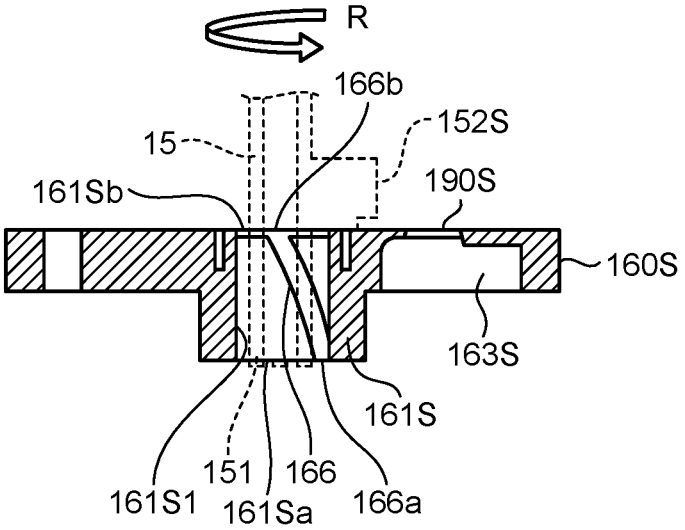
FIG. 5A is a vertical cross-sectional view illustrating an oil-supply groove of a sub bearing of the rotary compressor of the exemplary embodiment.
Figure 5B:
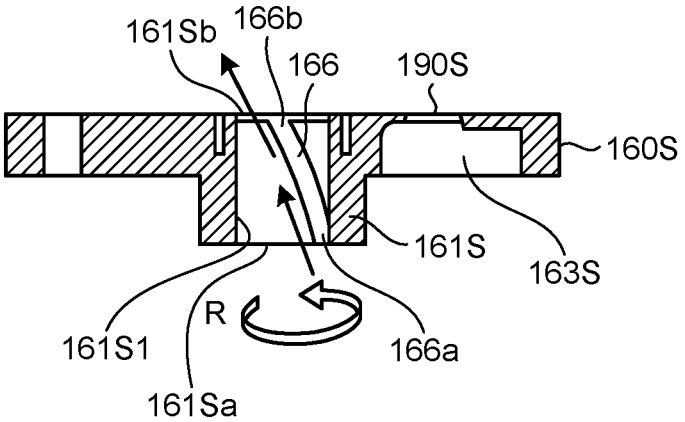
FIG. 5B is a vertical cross-sectional view illustrating the oil-supply groove of the sub bearing of the rotary compressor of the exemplary embodiment.
Figure 6:
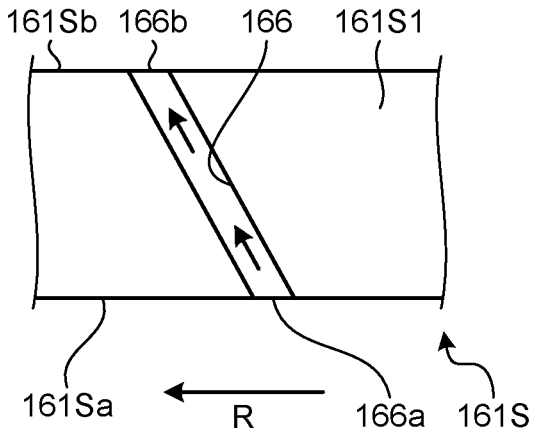
FIG. 6 is a schematic developed view illustrating an inner peripheral surface of a shaft hole of the sub bearing of the rotary compressor of the exemplary embodiment.

FIGS. 5A and 5B are vertical cross-sectional views illustrating the oil-supply groove 166 of the sub bearing 161S in the rotary compressor 1 of the exemplary embodiment. FIG. 6 is a schematic developed view illustrating an inner peripheral surface of the shaft hole 161S1 of the sub bearing 161S in the rotary compressor 1 of the exemplary embodiment. For convenience of description, FIG. 6 uses a developed plan view of the cylindrical inner peripheral surface of the shaft hole 161S1.

As illustrated in FIGS. 5A, 5B, and 6, the inner peripheral surface of the shaft hole 161S1 of the sub bearing 161S is provided with the oil-supply groove 166 having a helical shape that sucks up the lubricating oil 18 from a lower end 161Sa to an upper end 161Sb of the shaft hole 161S1 to supply the oil. When the rotary shaft 15 rotates in a rotating direction R, the sub bearing 161S appears to rotate relatively in the opposite direction to the rotating direction R of the rotary shaft 15. Here, the direction in which the oil-supply groove 166 is inclined with respect to the rotating direction R will be described when viewed with the rotating direction R of the rotary shaft 15 as the reference, rather than using the rotating direction of the sub bearing 161S as the reference.

As illustrated in FIG. 6, the oil-supply groove 166 is inclined with respect to the rotating direction R of the rotary shaft 15 and extends in the rotating direction R of the rotary shaft 15 from the lower end 161Sa toward the upper end 161Sb of the shaft hole 161S1. In other words, the oil-supply groove 166 is formed helically around the rotary shaft 15. The lubricating oil 18 in the oil-supply groove 166 is sucked up from the lower end 161Sa to the upper end 161Sb of the shaft hole 161S1 along the oil-supply groove 166 by the viscous pump action utilizing the viscosity of the lubricating oil 18 generated in the oil-supply groove 166. Unlike the centrifugal pump action in the oil-supply vertical hole 155, the oil-supply groove 166 that sucks up the lubricating oil 18 using the viscous pump action sucks up the lubricating oil 18 without being affected by the rotation speed of the rotary shaft 15. Accordingly, it is possible to suppress the reduction of the supply amount of the lubricating oil 18 when the shaft diameter of the rotary shaft 15 is small or when the rotation number of the rotary shaft 15 is low.

(Position of Upper End and Lower End of Oil-Supply Groove)

Figure 7:
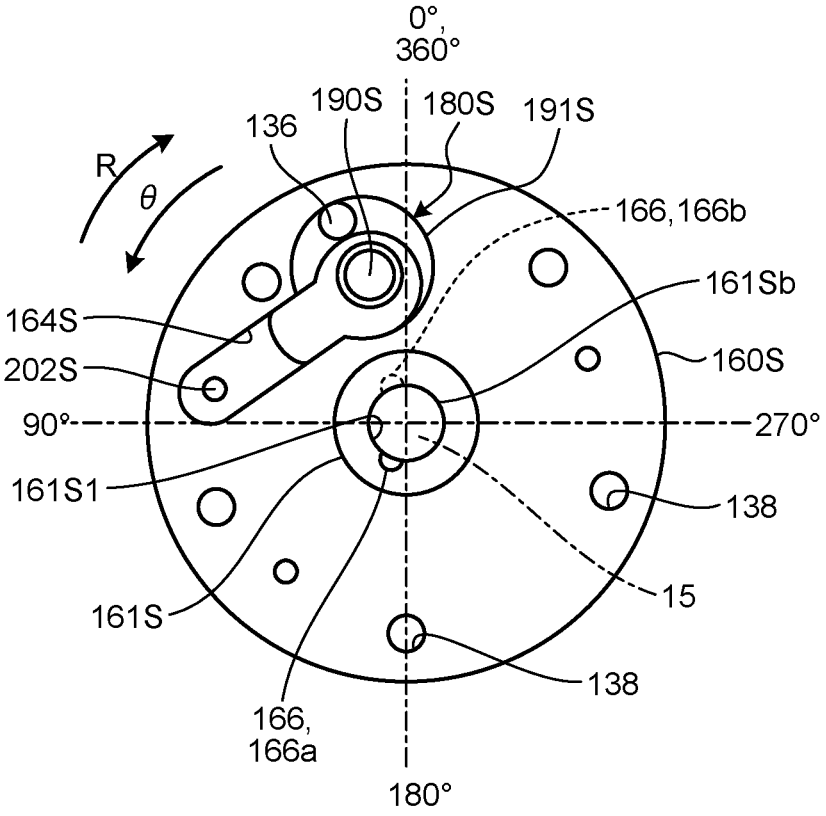
FIG. 7 is a bottom plan view of the sub bearing of a lower end plate of the rotary compressor of the exemplary embodiment.
Figure 8:
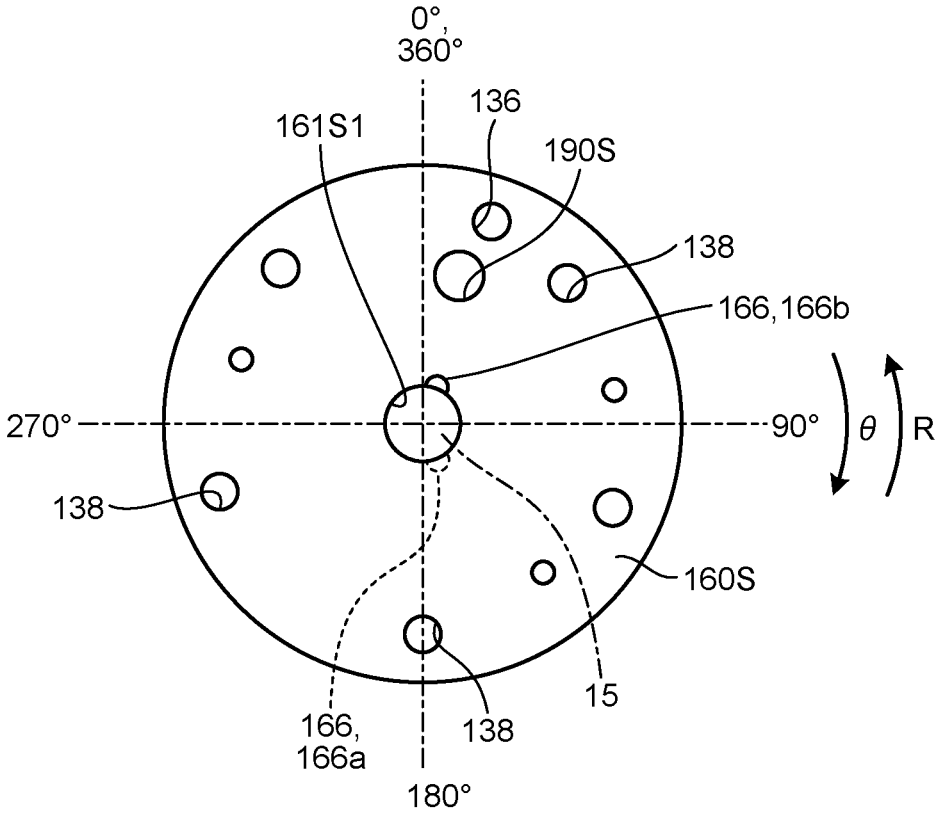
FIG. 8 is a top plan view of the sub bearing of the lower end plate of the rotary compressor of the exemplary embodiment.

FIG. 7 is a bottom plan view of the sub bearing 161S of the lower end plate 160S in the rotary compressor 1 of the exemplary embodiment. FIG. 8 is a top plan view of the sub bearing 161S of the lower end plate 160S in the rotary compressor 1 of the exemplary embodiment.

As illustrated in FIGS. 7 and 8, when a rotation angle θ with respect to the circumferential direction of the lower end plate 160S (the circumferential direction of the lower cylinder 121S and the circumferential direction of the sub bearing 161S) is 0° (360°) when the lower piston 125S is located at the top dead center, a lower end 166*a* and an upper end 166*b* of the oil-supply groove 166 are formed within a range of the rotation angle θ of 0° or more and 180° or less in the circumferential direction of the shaft hole 161S1. In other words, when the rotation angle θ of the position of the contact point between the lower piston 125S and the lower vane 127S when the lower vane 127S contracts the lower spring 126S most, that is, the position corresponding to the position of the lower vane 127S in the circumferential direction of the lower end plate 160S is 0°, the lower end 166*a* and the upper end 166*b* of the oil-supply groove 166 are disposed within the range of the rotation angle θ of 0° or more and 180° or less. As illustrated in FIG. 8, the upper end 166*b* of the oil-supply groove 166, that is, the outlet of the oil-supply groove 166 is formed within the range of the rotation angle θ of 0° or more and 900 or less in the circumferential direction of the shaft hole 161S1. In addition, as illustrated in FIG. 7, the lower end 166*a* of the oil-supply groove 166, that is, the inlet of the oil-supply groove 166 is formed within the range of the rotation angle θ of 90° or more and 180° or less in the circumferential direction of the shaft hole 161S1.

Here, the behavior of the rotary shaft 15 in the compression process will be described. In a partial range in the circumferential direction of the rotary shaft 15, for example, in a range where the rotation angle θ is within the range of $180° < \theta < 360°$, the load applied in the radial direction of the rotary shaft 15 in the compression process is relatively greater than in the range of $0° \leq \theta \leq 180°$. This is because the rotary shaft 15 is slightly bent by the reaction force received from the lower compression chamber 133S in the compression process. Therefore, when the angle is in the range of $180° < \theta < 360°$, the rotary shaft 15 is pressed toward the shaft hole 161S1 side of the sub bearing 161S, leading to the high likelihood of occurrence of contact between the outer peripheral surface of the rotary shaft 15 and the inner peripheral surface of the shaft hole 161S1 of the sub bearing 161S. On the other hand, the oil-supply groove 166 is formed by cutting the inner peripheral surface of the shaft hole 161S1 of the sub bearing 161S, and this leads to formation of an edge at the corner of the oil-supply groove 166. In addition, burrs (residual protrusions) generated during cutting are likely to remain in the oil-supply groove 166. Together with the high likelihood of occurrence of the situation in which the corner edge of the oil-supply groove 166 comes into contact with the outer peripheral surface of the rotary shaft 15, the sliding resistance between the shaft hole 161S1 of the sub bearing 161S and the rotary shaft 15 is likely to locally increase at the edge portion of the oil-supply groove 166. This would cause the lack of the lubricating oil 18 at the edge portion, leading to a risk of seizure between the edge portion and the rotary shaft.

To handle this, as described above, by disposing the oil-supply groove 166 within the rotation angle θ range of $0° \leq \theta \leq 180°$ in the circumferential direction of the shaft hole 161S1 of the sub bearing 161S, it is possible to avoid a situation in which the corner edge of the oil-supply groove 166 comes into contact with the outer peripheral surface of the rotary shaft 15 when the outer peripheral surface of the rotary shaft 15 is pressed against the inner peripheral surface of the shaft hole 161S1 in the compression process of the compression unit 12. This can avoid the local increase of the load at the edge of the oil-supply groove 166, making it possible to ensure the reliability in supply conditions of the lubricating oil 18 to the sliding portion of the sub bearing 161S.

Furthermore, the amount of lubricating oil 18 supplied from the oil-supply groove 166 to the sub bearing 161S is the amount of lubricating oil 18 supplied from the oil-supply vertical hole 155 to the main bearing 161T, or more. In other words, the depth and width of the oil-supply groove 166 and an inclination angle formed by the longitudinal direction of the oil-supply groove 166 with respect to the end surface the lower end 161Sa of the shaft hole 161S1 are set so that the supply amount of the lubricating oil 18 obtained by the oil-supply groove 166 becomes the total supply amount fed through the oil-supply vertical hole 155 of the rotary shaft 15, or more. With this configuration, the amount of lubricating oil 18 that is the amount of lubricating oil 18 supplied to the main bearing 161T and the upper cylinder 121T through the oil-supply vertical hole 155 will be properly supplied to the sub bearing 161S and the lower cylinder 121S by the oil-supply groove 166.

Furthermore, although one oil-supply groove 166 is provided in the sub bearing 161S in the present exemplary embodiment, for example, a plurality of the oil-supply grooves 166 may be provided at mutually shifted positions in the circumferential direction of the shaft hole 161S1. The supply amount of the lubricating oil 18 by the oil-supply groove 166 is affected by the viscosity of the lubricating oil 18 in the oil-supply groove 166. Therefore, when it is difficult to obtain a desired supply amount by one oil-supply groove 166, it would be possible to easily obtain a desired supply amount with the plurality of oil-supply grooves 166.

While the exemplary embodiment is a case where the rotary shaft 15 includes the oil-supply vertical hole 155 and oil-supply lateral holes 156*a* to 166*c*, the present invention is not limited to the configuration including the oil-supply vertical hole 155 and oil-supply lateral holes 156*a* to 166*c*, and may be configured to supply the lubricating oil 18 only by the oil-supply groove 166 of the sub bearing 161S.

Furthermore, an oil supply blade (not illustrated) that sucks up the lubricating oil 18 may be provided on the lower end side of the oil-supply vertical hole 155 of the rotary shaft 15. The oil supply blade is formed by twisting a thin metal plate around the axis of the rotary shaft 15 and is fitted into the inner peripheral surface of the oil-supply vertical hole 155. By using the oil supply blade, the supply amount of the lubricating oil 18 through the oil-supply vertical hole 155 can be ensured further stably.

(Flow of Lubricating Oil)

A flow of the lubricating oil 18 will be described below. With the rotation of the rotary shaft 15, the lubricating oil 18 is sucked up from the lower end of the rotary shaft 15 through the oil-supply vertical hole 155. The lubricating oil 18 passing through the oil-supply vertical hole 155 flows from the oil-supply vertical hole 155 and passes through the first oil-supply lateral hole 156*a*, the second oil-supply lateral hole 156*b*, and the third oil-supply lateral hole 156*c* to be supplied to the sliding surface between the main bearing 161T and the main shaft 153 of the rotary shaft 15, the sliding surface between the lower eccentric part 152S of the rotary shaft 15 and the lower piston 125S, and the sliding surface between the upper eccentric part 152T and the upper piston 125T, thereby lubricating each of the sliding surfaces.

In addition, together with the rotation of the rotary shaft 15, the lubricating oil 18 is sucked up from the lower end 161Sa to the upper end 161Sb of the shaft hole 161S1 of the sub bearing 161S through the oil-supply groove 166 of the sub bearing 161S. The lubricating oil 18 that has passed through the oil-supply groove 166 is supplied to the sliding surface between the sub bearing 161S and the sub shaft 151 of the rotary shaft 15, and the sliding surface between the lower eccentric part 152S of the rotary shaft 15 and the lower piston 125S, thereby lubricating each of the sliding surfaces. In addition, the lubricating oil 18 is supplied by the oil-supply vertical hole 155 and the oil-supply groove 166 as described above, whereby the sliding portions of the upper cylinder 121T and the lower cylinder 121S are sealed by the lubricating oil 18.

As described above, the lower end plate 160S of the rotary compressor 1 of the exemplary embodiment has a configuration in which the oil-supply groove 166 having a helical shape, which supplies the lubricating oil 18 from the lower end 161Sa to the upper end 161Sb of the shaft hole 161S1, is formed on the inner peripheral surface of the shaft hole 161S1 of the sub bearing 161S. The oil-supply groove 166 is inclined with respect to the rotating direction R of the rotary shaft 15 and extends from the lower end 166*a* to the upper end 166*b* in the rotating direction R of the rotary shaft 15. In a case where the shaft diameter of the rotary shaft 15 is small or where the rotation speed of the rotary shaft 15 is low at the time of supplying the lubricating oil 18 through the oil-supply vertical hole 155 of the rotary shaft 15, the centrifugal force generated in the lubricating oil 18 inside the oil-supply vertical hole 155 of the rotary shaft 15 is reduced, leading to a decrease in the amount of the lubricating oil 18 sucked up through the oil-supply vertical hole 155. In contrast, the exemplary embodiment has a configuration in which the oil-supply groove 166 provided in the sub bearing 161S sucks up the lubricating oil 18 by the viscous pump action that is not affected by the rotation number of the rotary shaft 15. Accordingly, even when the shaft diameter of the rotary shaft 15 is small or the rotation speed of the rotary shaft 15 is low, the lubricating oil 18 can be stably supplied to the sliding portions such as the sub bearing 161S without depending on the centrifugal force of the rotary shaft 15. Furthermore, with the presence of the oil-supply groove 166, it is possible to ensure a sufficient amount of lubricating oil 18 to be supplied to the compression unit 12. This makes it possible to improve sealability particularly in the gaps in each of sliding portions (for example, gap between the lower end plate 160S and the lower piston 125S, and between the intermediate partition plate 140 and the lower piston 125S) in the height direction (axial direction of the rotary shaft 15) of the compression unit 12, leading to suppression of the deterioration in compression efficiency of the rotary compressor 1.

In addition, compared with the fact that the height at which the lubricating oil 18 can be sucked up by the oil-supply vertical hole 155 is about the surface level of the lubricating oil 18 in the compressor housing 10, the oil-supply groove 166 makes it possible to suck up the lubricating oil 18 by utilizing the viscous pump action as long as the surface level of the lubricating oil 18 reaches the lower end 166*a* of the oil-supply groove 166. Therefore, even when the surface level of the lubricating oil 18 becomes low after the lubricating oil 18 is discharged together with the refrigerant from the inside of the compressor housing 10, the oil-supply groove 166 can properly supply the lubricating oil 18 to each of the sliding portions of the sub bearing 161S and the lower cylinder 121S. Consequently, the oil-supply groove 166 can improve the stability of the supply conditions to the sliding portion. Furthermore, by forming the oil-supply groove 166 in the shaft hole 161S1 of the sub bearing 161S, it is possible to easily process the oil-supply groove 166 as compared with the case where the oil-supply groove 166 is formed in the rotary shaft 15 having high hardness.

Furthermore, in the lower end plate 160S of the rotary compressor 1 of the exemplary embodiment, when the rotation angle θ with respect to the circumferential direction of the lower end plate 160S is 0° when the lower piston 125S is located at the top dead center, the lower end 166*a* and the upper end 166*b* of the oil-supply groove 166 are formed within the range of the rotation angle θ of 0° or more and 180° or less in the circumferential direction of the shaft hole 161S1. This configuration makes it possible to avoid a situation in which the rotary shaft 15 is pressed against the shaft hole 161S1 in the compression process of the compression unit 12 causing the corner edges of the oil-supply groove 166 to come into contact with the outer peripheral surface of the rotary shaft 15 and locally increasing the load on the edge. Accordingly, the reliability of the supply conditions of the lubricating oil 18 to the sliding portion of the sub bearing 161S is ensured thereby avoiding occurrence of the seizure at the sub bearing 161S.

Furthermore, the rotary shaft 15 of the rotary compressor 1 of the exemplary embodiment is provided with the first oil-supply lateral hole 156*a*, the second oil-supply lateral hole 156*b* and the third oil-supply lateral hole 156*c* at positions other than the position to face the oil-supply groove 166 when the rotary shaft 15 rotates. Since the shaft hole 161S1 of the sub bearing 161S is constantly lubricated by the lubricating oil 18 sucked up by the oil-supply groove 166, it possible to omit the formation of the oil-supply lateral hole in the sub shaft 151. This makes it possible to suppress deterioration of the mechanical strength of the sub shaft 151 due to the formation of the oil-supply lateral hole.

In addition, in the rotary compressor 1 of the exemplary embodiment, the amount of lubricating oil 18 supplied from the oil-supply groove 166 to the sub bearing 161S is the amount of the lubricating oil 18 supplied from the oil-supply vertical hole 155 to a main bearing 166T, or more. With this configuration, the amount of lubricating oil 18, which is the amount of lubricating oil 18 supplied to the main bearing 161T and the upper cylinder 121T through the oil-supply vertical hole 155, or more, will be properly supplied to the sliding portions of the sub bearing 161S and the lower cylinder 121S by the oil-supply groove 166.

While the above-described exemplary embodiment is an exemplary configuration applied to the two-cylinder type rotary compressor, the present invention is not limited to the two-cylinder type and may be applied to a one-cylinder type rotary compressor.

REFERENCE SIGNS LIST

1 ROTARY COMPRESSOR
10 COMPRESSOR HOUSING
11 MOTOR
12 COMPRESSION UNIT
15 ROTARY SHAFT
18 LUBRICATING OIL
105 UPPER SUCTION PIPE (SUCTION UNIT)
104 LOWER SUCTION PIPE (SUCTION UNIT)
107 DISCHARGE PIPE (DISCHARGE UNIT)
121T UPPER CYLINDER
121S LOWER CYLINDER
125T UPPER PISTON
125S LOWER PISTON
130T UPPER CYLINDER CHAMBER
130S LOWER CYLINDER CHAMBER
151 SUB SHAFT
152T UPPER ECCENTRIC PART
152S LOWER ECCENTRIC PART
153 MAIN SHAFT
155 OIL-SUPPLY VERTICAL HOLE
156*a* FIRST OIL-SUPPLY LATERAL HOLE
156*b* SECOND OIL-SUPPLY LATERAL HOLE
156*c* THIRD OIL-SUPPLY LATERAL HOLE
160T UPPER END PLATE
160S LOWER END PLATE
161T MAIN BEARING
161S SUB BEARING
161S1 SHAFT HOLE
161Sa LOWER END
161Sb UPPER END
166 OIL-SUPPLY GROOVE
166*b* UPPER END
166*a* LOWER END
R ROTATING DIRECTION
θ ROTATION ANGLE

The invention claimed is:

1. A rotary compressor comprising:

a compressor housing hermetically sealed, having a cylindrical shape to be vertically arranged, being provided with a discharge unit and a suction unit of refrigerant, and configured to store lubricating oil in a lower part of the compressor housing;

a compression unit disposed at a lower part of the compressor housing and configured to compress the refrigerant sucked from the suction unit and discharge the compressed refrigerant from the discharge unit; and a motor disposed on an upper part of the compressor housing and configured to drive the compression unit, wherein the compression unit includes:

a cylinder having an annular shape;

an upper end plate that closes an upper side of the cylinder;

a lower end plate that closes a lower side of the cylinder;

a main bearing provided on the upper end plate;

a sub bearing provided on the lower end plate;

a rotary shaft supported by the main bearing and the sub bearing so as to be rotated by the motor; and a piston having an annular shape, and configured to be fitted to an eccentric part of the rotary shaft and to revolve along an inner peripheral surface of the cylinder so as to form a cylinder chamber within the cylinder, wherein the rotary shaft comprises a first oil-supply path configured to suck up the lubricating oil from a lower end of the rotary shaft, the first oil-supply path having an oil-supply vertical hole extending from the lower end of the rotary shaft in an axial direction and an oil-supply lateral hole extending in a direction intersecting the oil-supply vertical hole inside the rotary shaft, and wherein the sub bearing comprises a second oil-supply path configured to suck up the lubricating oil from a lower end of the sub bearing, the second oil-supply path being provided in an inner peripheral surface of a shaft hole of the sub bearing and having a helical oil-supply groove supplying the lubricating oil from a lower end to an upper end of the shaft hole, the oil-supply groove being inclined with respect to the rotary shaft in a rotating direction and extending from the lower end toward the upper end of the shaft hole in the rotating direction of the rotary shaft.

2. The rotary compressor according to claim 1, wherein, when a rotation angle with respect to a circumferential direction of the lower end plate is 0° when the piston is located at a top dead center, the lower end and the upper end of the oil-supply groove are formed within a range of the rotation angle θ of 0° or more and 180° or less at the shaft hole in a circumferential direction.

3. The rotary compressor according to claim 1, wherein the rotary shaft internally includes: an oil-supply vertical hole extending from the lower end of the rotary shaft in an axial direction; and an oil-supply lateral hole extending in a direction intersecting the oil-supply vertical hole.

4. The rotary compressor according to claim 3, wherein the oil-supply lateral hole is provided only at a position other than a position to face the oil-supply groove when the rotary shaft rotates.

5. The rotary compressor according to claim 2, wherein the rotary shaft internally includes: an oil-supply vertical hole extending from a lower end of the rotary shaft in an axial direction; and an oil-supply lateral hole extending in a direction intersecting the oil-supply vertical hole.

6. The rotary compressor according to claim 5, wherein the oil-supply lateral hole is provided only at a position other than a position to face the oil-supply groove when the rotary shaft rotates.

7. The rotary compressor according to claim 1, wherein an upper end of the oil-supply groove is formed within a range of the rotation angle of 0° or more and 90° or less, and an lower end of the oil-supply groove is formed within a range of the rotation angle of 90° or more and 180° or less.

* * * * *